US005148911A

United States Patent [19]

Miller et al.

[11] Patent Number: 5,148,911

[45] Date of Patent: Sep. 22, 1992

[54] SENSING EDGE SWITCH

[75] Inventors: Bearge D. Miller, Concordville; Anatoly Galperin, Philadelphia, both of Pa.

[73] Assignee: Miller Edge, Inc., Concordville, Pa.

[21] Appl. No.: 785,621

[22] Filed: Oct. 31, 1991

[51] Int. Cl.[5] ..... H01H 3/16

[52] U.S. Cl. ..... 200/61.43

[58] Field of Search ..... 200/61.43, 86 R; 49/26–28

[56] References Cited

U.S. PATENT DOCUMENTS

| | | | |
|---|---|---|---|
| 2,595,291 | 5/1952 | Ramsey et al. | 200/61.43 X |
| 2,843,690 | 7/1958 | Miller | 200/61.43 |
| 3,315,050 | 4/1967 | Miller | 200/61.43 |
| 3,693,026 | 9/1972 | Miller | 307/119 |
| 3,732,384 | 5/1973 | Fischel | 200/86 R |
| 3,754,176 | 8/1973 | Miller | 318/266 |
| 3,812,313 | 5/1974 | Wolf et al. | 200/86 R |
| 3,855,733 | 12/1974 | Miller | 49/488 |
| 3,867,595 | 2/1975 | Ramsey et al. | 200/86 R |
| 4,066,851 | 1/1978 | White et al. | 200/5 A |
| 4,080,519 | 3/1978 | Michalson | 200/86 R |
| 4,090,045 | 5/1978 | Marsh | 200/5 A |
| 4,273,974 | 6/1981 | Miller | 200/61.43 |
| 4,362,911 | 12/1982 | Sears et al. | 200/5 A |
| 4,396,814 | 8/1983 | Miller | 200/61.43 |
| 4,401,896 | 8/1983 | Fowler et al. | 307/118 |
| 4,532,388 | 7/1985 | Sackmann et al. | 200/61.43 |
| 4,565,910 | 1/1986 | Musick et al. | 200/85 R |
| 5,027,552 | 7/1991 | Miller et al. | 49/27 |
| 5,087,799 | 2/1992 | Pariot et al. | 200/61.43 |

*Primary Examiner*—J. R. Scott

*Attorney, Agent, or Firm*—Panitch Schwarze Jacobs & Nadel

[57] ABSTRACT

A sensing edge for causing an object moving in a first direction to move in a second direction by actuation of a device upon force being applied to the sensing edge. The sensing edge includes a base member for being secured to the object. A first elongate wall extends from the base member to form a generally enclosed cavity. A second elongate wall extends from the base member such that the second wall is positioned within the cavity between the first wall and the base member. A switch is positioned within the cavity between the first and second walls for actuation of the device upon application of external pressure to the first wall.

8 Claims, 2 Drawing Sheets

SENSING EDGE SWITCH

FIELD OF THE INVENTION

The present invention relates to a sensing edge for a moving object and, more particularly, to a sensing edge which is easily and securely mounted to a moving object.

BACKGROUND OF THE INVENTION

Moving filing systems are comprised of a series of moving walls having shelving for receiving files and the like. When it is desired to access a particular file, an operator instructs the system through a control panel or other control means to move two of the walls from a first position wherein the walls are in close facing engagement such that an operator cannot walk between the walls to a second position wherein at least two of the walls move away from each other to allow an operator to walk therebetween and access the files. Such systems often include redundant safety features to prevent the walls from closing while an operator is standing therebetween. Such safety features include standard weight sensing floor mats, kick panels positioned along the bottom of the walls and sensing edges extending along the shelving. The sensing edges typically extend outwardly from the horizontal shelving such that if a person were positioned between two walls as they were closing, the sensing edge would contact the upper body of the person and actuate a device to cause the walls to either cease moving or move away from the person.

Conventional sensing edges used with moving filing systems have been problematic. Such sensing edges do not have the ability to sense contact therewith along the entire length thereof. Moreover, such sensing edges are not durable. That is, as a file is removed from the shelving, the bottom of the file scrapes or drags across the upper portion of the sensing edge which, over time, causes the sensing edge either to separate and fail or become disconnected from the shelving. In addition, such sensing edges have only been sensitive to horizontally acting forces, as opposed to vertically or angled acting forces.

The present invention is directed to a sensing edge for causing an object moving in a first direction to move in a second direction by actuation of a device upon force being applied to the sensing edge. The sensing edge of the present invention overcomes many of the problems inherent in the above-described sensing edges by securely mounting the sensing edge to the object and by molding the external surfaces of the sensing edge as one piece. Moreover, the sensing edge of the present invention is sensitive to both horizontal and vertical forces acting along the entire length of the sensing edge. Consequently, use of the present invention results in considerable savings in money since it is more durable than the prior art sensing edges and is generally more effective because it is sensitive to both vertical and horizontal forces acting anywhere along its length.

SUMMARY OF THE INVENTION

Briefly stated, the present invention comprises a sensing edge for controlling movement of an object moving in a first direction by actuation of a device upon force being applied to the sensing edge. The sensing edge comprises an elongate base member for being secured to the object. The base member is constructed of a generally rigid material. A first elongate wall is provided and has a first end and a second end. The first wall includes an intermediate portion disposed between the first and second ends. The first and second ends are secured to the base member to form with the base member a cavity such that the intermediate portion is spaced from the base member. The first wall is constructed of a flexible material such that the first wall is compressible into the cavity upon application of external pressure thereto. A switch means is positioned within the cavity between the first wall and the base members for actuation of the device upon application of external pressure to the first wall.

BRIEF DESCRIPTION OF THE DRAWINGS

The foregoing summary, as well as the following detailed description of the preferred embodiments, will be better understood when read in conjunction with the appended drawings. For the purpose of illustrating the invention there is shown in the drawings embodiments which are presently preferred, it is understood, however, that the invention is not limited to the specific methods and instrumentalities disclosed. In the drawings.

DETAILED DESCRIPTION OF PREFERRED EMBODIMENTS

Figure 1:
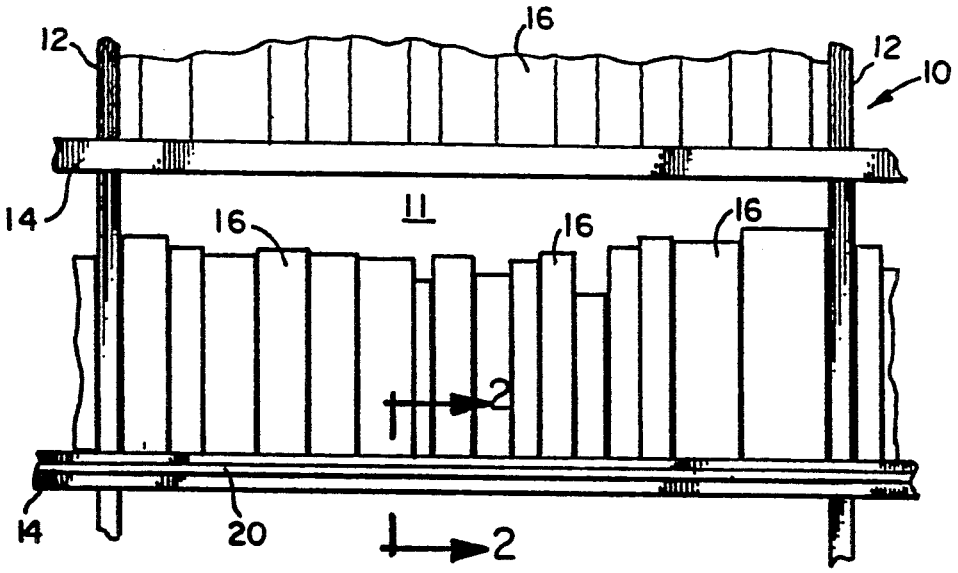
FIG. 1 is a front elevational view partially showing a wall of a movable filing system having a sensing edge in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the sensing edge and designated parts thereof. The terminology includes the words above specifically mentioned, derivatives thereof and words of similar import.

Referring to the drawings in detail, wherein like numerals indicate like elements throughout, there is shown in FIG. 1 a portion of a wall 11 of a movable filing system, generally designated 10. The filing system 10 is comprised of a plurality of movable walls 11 (only one is shown) each having a series of vertically extending support members 12 (only two are shown) which support a series of spaced horizontal shelves 14 to thereby provide space for storing a plurality of files 16, as is understood by those skilled in the art. Each wall 11 moves with respect to the other walls 11 between a closed position wherein the walls 11 are compact or compressed together and a second position wherein a selected two of the walls 11 are spaced from each other to allow access to the files 16 on the horizontal shelves 14.

It is understood by those skilled in the art that the present invention is equally applicable to other types of movable filing systems. For instance, the present invention is equally applicable to filing systems which have walls that move along the longitudinal axis thereof. Since movable filing systems are well known to those skilled in the art and do not form a part of the present invention, further description thereof is omitted for purposes of convenience only.

Figure 2:
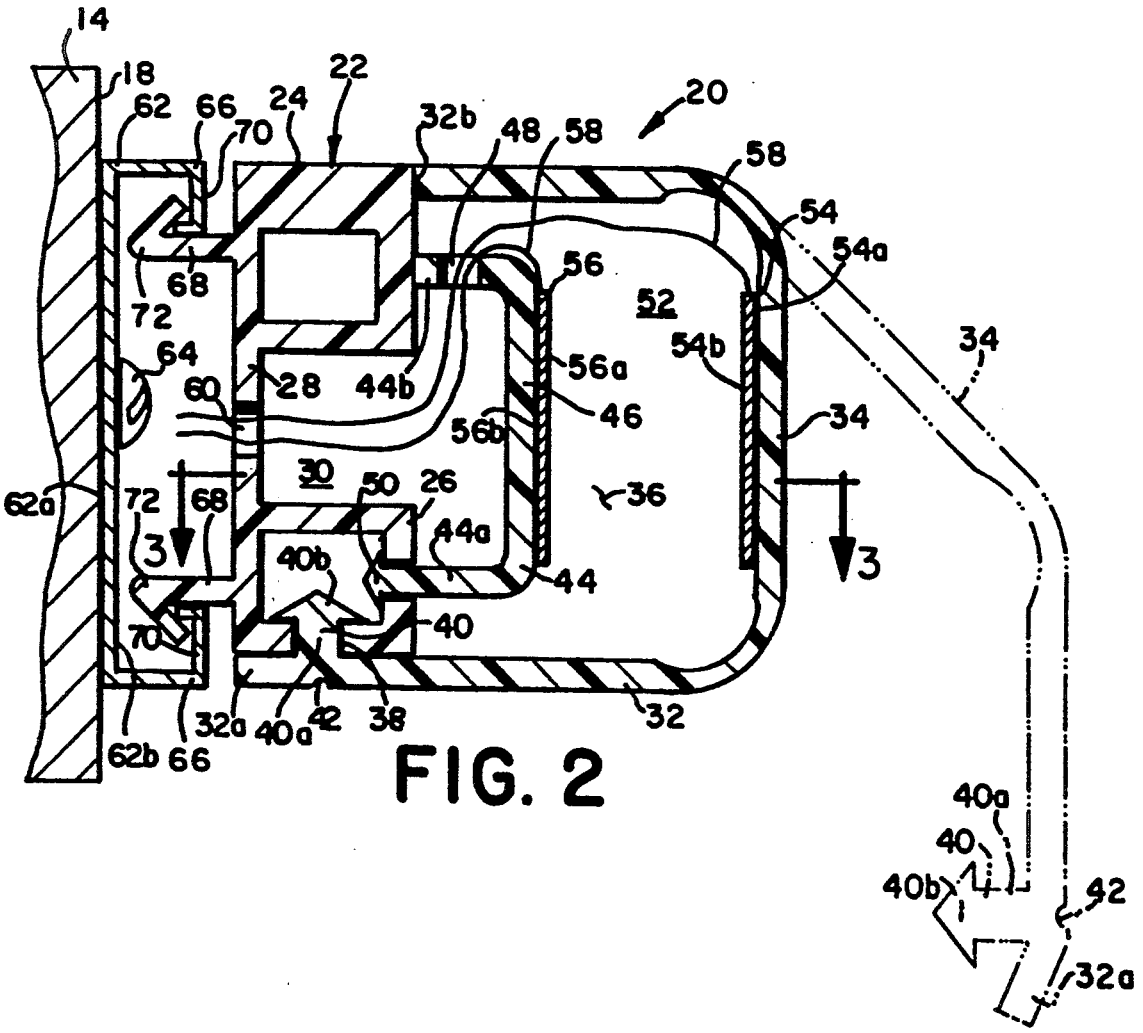
FIG. 2 is a greatly enlarged cross-sectional view of the sensing edge of FIG. 1 taken along line 2—2 of FIG. 1.

Referring now to FIGS. 1 and 2, extending along the leading edge 18 of the horizontal shelf 14 is a sensing edge 20. While in the present embodiment, it is preferred that the sensing edge 20 be secured to a horizontal shelf 14 of a movable filing system 10, it is understood by those skilled in the art that the sensing edge 20 can be positioned on any object, such as a door edge or on the vertical support members 12, without departing from the spirit and scope of the invention.

Referring now to FIG. 2, the sensing edge 20 is comprised of an elongate base member 22 for being secured to the leading edge 18 of the horizontal shelf 14. The elongate base member 22 preferably extends substantially the entire length of the horizontal shelf 14 to maximize the sensing area. The base member 22 is comprised of an upper channel 24, a lower channel 26 and an intermediate wall 28 therebetween. The upper channel 24, lower channel 26 and intermediate wall 28 extend the length of the base member 22. As best shown in FIG. 2, the upper and lower channels 24, 26 are hollow and generally rectangular in cross section. The upper and lower channels 24, 26 are preferably spaced from each other by the intermediate wall 28 to thereby form a trough 30 therebetween. The trough 30 and hollow portions of the upper and lower channels 24, 26 can be used as conduits for electrical wires and the like, as described in more detail hereinafter.

While in the present embodiment, it is preferred that the base member 22 be formed of an upper channel 24, lower channel 26 and intermediate wall 28, it is understood by those skilled in the art that the base member 22 could be of other configurations. For instance, the base member 22 could be hollow and generally rectangular across its entire cross section (not shown). Hence, the present invention is not limited to shaping or configuring the base member 22 in any particular manner.

In the present embodiment, it is preferred that the base member 22 be constructed of a generally rigid material, such as neoprene, which is capable of being co-extruded with a different material, as discussed in more detail hereinafter. Furthermore, it is preferred that the base member 22 be formed by an extrusion molded process. However, it is understood by those skilled in the art that the base member 22 could be constructed of other materials, such as polyvinylchloride, Santoprene made by Monsanto or other polymeric materials so long as the base member 22 remains sufficiently rigid to provide the sensing edge 20 with structural integrity. Similarly, the base member 22 could be formed in other manners, such as die molding or milling, without departing from the spirit and scope of the invention.

As shown in FIG. 2, the sensing edge 20 includes a first elongate wall 32 having a first end 32*a* and a second end 32*b*. The first wall 32 includes an intermediate portion 34 disposed between the first and second ends 32*a*, 32*b* thereof. The first and second ends 32*a*, 32*b* are secured to the lower and upper channels 24, 26, respectively, of the base member 22 to form with the base member 22 a generally enclosed cavity 36 such that the intermediate portion 34 is spaced from the base member 22. When the first and second ends 32*a*, 32*b* are secured to the base member 22, the first wall 32 is generally U-shaped in cross section such that the intermediate portion 34 is generally parallel to the leading edge 18 of the horizontal shelf 14.

In the present embodiment, it is preferred that the first wall 32 be constructed of a flexible material such that the first wall 32 is compressible into the cavity 36 upon application of external pressure thereto. It is preferred that the flexible material be a polymeric material, such as polyvinyl chloride, which can be co-extruded with the material of the base member 22. However, it is understood by those skilled in the art that the first wall 32 could be constructed of other flexible materials, such as polyvinylchloride or Santoprene made by Monsanto or a combination of PVC and neoprene. As mentioned previously, it is preferred that the base member 22 and first wall 32 be constructed of a material which is suitable for coextrusion so that the second end 32*b* of the first wall 32 is secured to the upper channel 24 during the coextrusion process. Since the first end 32*b* of the wall 32*b* is coextruded with the upper channel 24 of the base member 22, it is unlikely that the first wall 32 will separate from the base member 22 as files are removed from the horizontal shelving 14, and bump or rub against the upper side of the first wall 32.

As shown in FIG. 2, the first end 32*a* of the first wall 32 is releasably secured to the lower channel 26 of the base member 22 for allowing the first wall 32 to move towards and away from (as shown in phantom) the base member 22 about the second end 32*b* thereof to provide access to the cavity 36, thus facilitating repair and manufacture of the sensing edge 20. In the present embodiment, it is preferred that the first end 32*a* be releasably secured to the lower channel 26 of the base member 22 by a snap-fit arrangement. That is, the lower channel 26 includes a slot 38 extending along the lower wall thereof the entire length of the base member 22. A finger 40 extends inwardly from the interior surface of the first wall 32 proximate the first end 32*a*. The finger 40 has a first portion 40*a* which is shaped to complement the slot 38 and a second portion 40*b* which is generally triangularly shaped in cross section and is sized to snap into the hollow portion of the lower channel 26. The finger 40 preferably extends the entire length of the first wall 32 to ensure that the first end 32*a* is securely attached to the lower channel 26.

It is understood by those skilled in the art that other means can be used to releasably secure the first end 32*a* of the first wall 32 to the lower channel 26 of the base member 22. For instance, the finger 40 could be friction fit within the slot 38 or the lower channel 26 could be solid for receiving standard fasteners. If desired, the first end 32*a* of the first wall 32 can be permanently secured to the lower channel 26 by depositing an adhesive (not shown) within the hollow portion of the lower channel 26 along with the second portion 40*b* of the finger 40.

As best shown in FIG. 2, a generally semicircular groove 42 extends along the exterior surface of the first wall 32 proximate the first end 32*a* and opposite the finger 40. The groove 42 provides a gripping surface for purposes of automated assembly of the sensing edge 20. In addition, the portion of the first end 32*a* of the wall 32 extending beyond the finger 40 is formed at an angle with respect to the remaining portion of the first wall 32 (as best shown in phantom) to provide a tight seal between the first end 32*a* of the first wall 32 and the lower channel 26.

Figure 3:
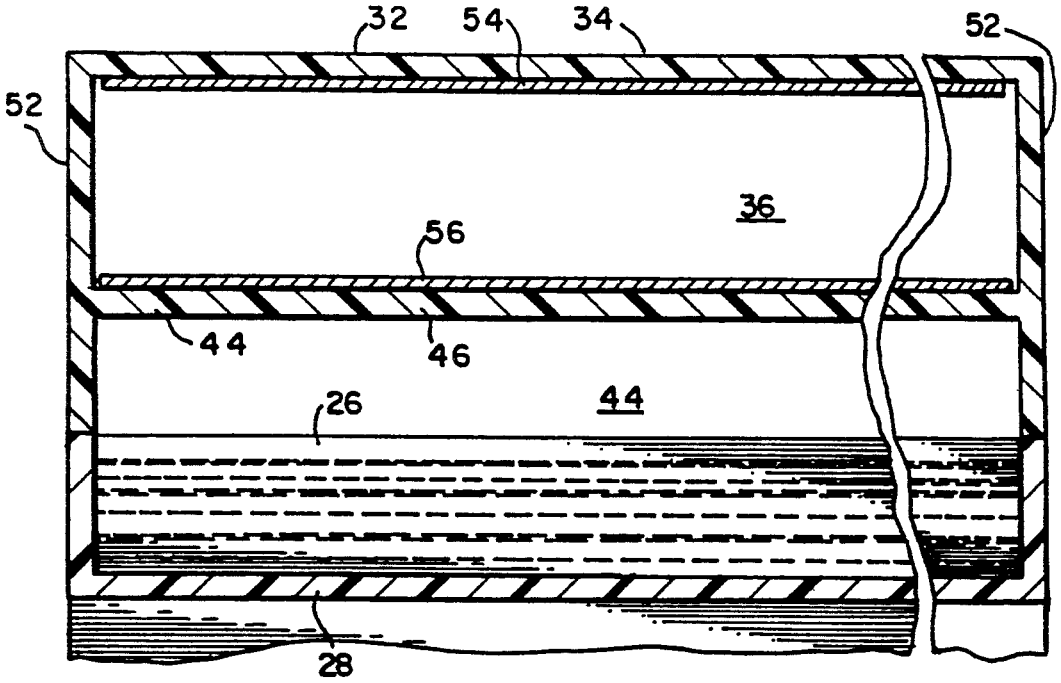
FIG. 3 is a cross-sectional view of the sensing edge of FIG. 2 taken along line 3—3 of FIG. 2.

Referring now to FIGS. 2 and 3, the sensing edge 20 includes a second elongate wall 44 having a first end 44*a* and a second end 44*b*. The first and second ends 44*a*, 44*b* are secured to the lower and upper channels 26, 24, respectively, of the base member 22 such that the second wall 44 is positioned within the cavity 36 between the first wall 32 and the base member 22. Further, the second wall 44 is spaced from the first wall 32. In the present embodiment, it is preferred that the second wall 44 include an intermediate portion 46 disposed between the first and second ends 44*a*, 44*b* thereof. The intermediate portion 46 of the second wall 44 is preferably spaced from the base member 22 and is generally aligned and parallel with the intermediate portion 34 of the first wall 32.

It is preferred that the second wall 44 be generally U-shaped in cross section, as shown in FIG. 2. However, it is understood by those skilled in the art that the second wall 44 could be of other configurations. For instance, the second wall 44 could be generally planar and extend between the upper and lower channels 24, 26 without a space therebetween. Further, the second wall 44 could be interconnected between the first and second ends 32*a*, 32*b* of the first wall 32 and not be formed as part of the base member 22 (not shown). The second end 44*b* of the second wall 44 preferably includes an aperture 48 extending therethrough for providing access to the trough 30.

In the present embodiment, it is preferred that the second end 44*b* of the second wall 44 be secured to the upper channel 24 during a coextrusion process as in the connection between the second end 32*b* of the first wall 32 and the upper channel 24, described above. Similarly, the first end 44*a* of the second wall 44 includes a triangularly shaped finger 50 releasably positioned within the hollow portion of the lower channel 26 much like the connection between the first end 32*a* of the first wall 32 and the lower channel 26. However, it is understood by those skilled in the art that the ends of the first and second walls 32, 44 can be secured to the base member 22 in any fashion, such as by an adhesive, without departing from the spirit and scope of the invention.

As mentioned above, it is preferred that the intermediate portion 46 of the second wall 44 be spaced from the base member 22. It is also preferred that the second wall 44 be constructed of a flexible material which, combined with the spacing between the base member 22 and second wall 44, minimizes damage due to overtravel, as discussed in more detail hereinafter. It is preferred that the flexible material of the second wall 44 be generally the same as the flexible material of the first wall 34, described above. However, it is understood by those skilled in the art that the first and second walls 32, 44 could be constructed of relatively different materials without departing from the spirit and scope of the invention. For instance, if the second wall 44 is not spaced from the base member 22, it could be constructed of a relatively rigid material.

Referring now to FIG. 3, at the longitudinal ends of the sensing edge 20 are a pair of end walls 52 which close and seal each end of the sensing edge 20 to thereby further define the cavity 36. The end walls 52 are preferably formed during the extrusion process and are constructed of the same material as the first wall 32 to thereby allow the sensing edge 20 to be sensitive along its entire length. However, it is understood by those skilled in the art that the end walls 52 could be constructed of other materials, such as a generally rigid polymeric material, and/or be secured to the first and second walls 32, 44 in other manners, such as by an adhesive or ultrasonic welding.

Referring now to FIG. 2, a switch means is positioned within the cavity 36 between the first wall 32 and the second wall 44 for actuation of a device (not shown) for causing a closing wall 11 to open upon application of external pressure to the first wall 32. It is understood by those skilled in the art that the switch means could cause other actions. For instance, the wall 11 could merely stop moving.

In the present embodiment, it is preferred that the switch means be comprised of a first flexible, electrically conductive contact 54 having a first face 54*a* and a second face 54*b*. The first contact 54 is positioned between the first and second walls 32, 44 with the first face 54*a* of the first contact 54 being in facing engagement with the interior surface of the first wall 34. More particularly, it is preferred that the first face 54*a* of the first contact 54 be in complementary facing engagement with the intermediate portion 34 of the first wall 54.

The switch means preferably further includes a second electrically conductive contact 56 having a first face 56*a* and a second face 56*b*. The second contact 56 is positioned between the first and second walls 32, 44 with the second face 56*b* of the second contact 56 in facing engagement with the second wall 44. More particularly, it is preferred that the second face 56*b* of the second contact 56 be in complementary facing engagement with the intermediate portion 46 of the second wall 56 whereby upon application of external pressure to the first wall 32, a portion of the first contact 54 deflects into the cavity towards the second contact 56 and engages and makes electrical contact therewith to thereby actuate the device.

It is understood by those skilled in the art that the second contact 56 could be omitted and the second wall 44 could be constructed of an electrically conductive material which can be extruded along with the base member 22. Such materials are commonly referred to as electrically conductive plastics. In addition, the second wall could be constructed of a metallic material, such as brass. In such a case, the second wall 44 would have to be secured to the base member 22 in other manners, such as by an adhesive.

In the present embodiment, it is preferred that the first and second contacts 54, 56 be generally sized to complement the intermediate portions 34, 46 of the first and second walls 32, 44 and are preferably adhesively secured thereto. However, it is understood by those skilled in the art that the first and second contacts 54, 56 can be sized as wide or narrow as desired, and may be of any desired length for accommodating different structures and uses.

As shown in FIG. 2, electrical conductors or wires 58 are electrically connected to the first and second contacts 54, 56 preferably by soldering at one end thereof. The electrical conductors 58 are used in connection with a circuit (not shown) for controlling the actuation of the device, as is understood by those skilled in the art, in response to the application of external pressure to the first wall 32, as described above. The electrical connectors 58 preferably extend through the aperture 48 in the second wall 44 and extend along the trough 30 within the base member 22. The intermediate wall 28 of the base member 22 includes an aperture 60 for allowing the electrical conductors 58 to pass therethrough to the controlling circuitry.

In the present embodiment, it is preferred that the first and second contacts 54, 56 be in the form of a generally thin sheet and are preferably constructed of aluminum or aluminum foil. However, it is within the spirit and scope of the invention to construct the first and second contact 54, 56 of other conductive materials, such as copper, brass or an alloy thereof. Further, it is also within the spirit and scope of the invention to construct the second contact 56 of a generally rigid material when the second wall 44 is also constructed of a generally rigid material.

In the present embodiment, the area of the cavity 36 between the first and second contacts 54, 56 allows the first wall 32 to be readily deflectable towards the second wall 44. The material of the first and second walls 32, 44 is preferably constructed such that first and second walls 32, 44 have sufficient memory to assume the position shown in FIG. 2 when a force applied to the sensing edge 20 is released. However, it is understood by those skilled in the art that a perforated foam (not shown) could be positioned between the first and second contacts 54, 56 to assist in retaining the shape of the sensing edge 20.

Referring now to FIG. 2, the sensing edge 20 further includes a mounting plate 62 having a first surface **62*a* and a second surface 62*b*. The first surface 62*a* is attached to the leading edge 18 of the horizontal shelf 14 and preferably extends the length of the base member 22. In the present embodiment, it is preferred that the mounting plate 62 be secured to the leading edge 18 of the horizontal shelf 14 by a standard fastener, such as a screw 64. However, it is understood by those skilled in the art that the mounting plate 62 can be secured to the leading edge 18 of the horizontal shelf 14 in other manners, such as by an adhesive. Moreover, the mounting plate 62 could be formed as part of the horizontal shelf 14**.

As shown in FIG. 2, quick-connect means is interconnected between the base member 22 and the mounting plate 62 for quickly connecting and disconnecting the base member 22 and the mounting plate 62. In the present embodiment, it is preferred that the quick-connect means be comprised of at least one female member 66 extending outwardly from the second surface **62*b* of the mounting plate 62 and at least one complementary male member 68 extending outwardly from the base member 22 for being releasably positioned within the female member 66. In the present embodiment, it is preferred that the female member 66 be formed by a pair of channels 70 which extend the length of the mounting plate 62 and which are generally hook-shaped in cross section. Similarly, it is preferred that the male member 68 be comprised of a pair of complementarily hook-shaped elements 72 extending from the base member 22 along the entire length thereof which can be snap-fit or slideably disposed within the corresponding channels 70**.

While in the present embodiment, it is preferred that the quick-connect means be comprised of a pair of corresponding male and female members 68, 66, it is understood by those skilled in the art that other means could be utilized to quickly connect and disconnect the base member 22 and the mounting plate 62. For instance, the mounting plate 62 could be generally U-shaped in cross-section and the interior surfaces of the legs thereof could include a series of ratchet-like teeth (not shown). The sensing 20 could also include oppositely disposed ratchet-like teeth (not shown) on the exterior surface thereof to be placed in corresponding engagement with the ratchet-like teeth on the mounting plate 62.

In addition, it is understood by those skilled in the art that the base member 22 could be directly secured to the leading edge 18 of the horizontal shelf 14 without the aid of the mounting plate 62. To secure the base member 22 to the leading edge 18 without the mounting plate 62, the first ends **32*a*, 44*a* of the first and second walls 32, 44 are disconnected from the lower channel 26 of the base member 22 and moved away to access the trough 30. Standard fasteners can then be positioned through apertures (not shown) in the intermediate wall 28 directly into the horizontal shelf 14. In this case, the electrical conductors 58 could still extend through the trough 30 or through the hollow portion of the upper channel 34** (not shown).

Referring now to FIG. 2, it is preferred that the distance between the first ends **32*a*, 44*a* of the first and second walls 32, 44 be less than the width of the intermediate portions 34, 46 such that vertically acting forces cause the first wall 32 to fold over the second wall 44 and cause the first and second contacts 54, 56 to make electrical contact. Thus, the sensing edge 20** of the present invention is particularly sensitive to both vertically and horizontally acting forces.

Referring now to FIG. 3, it can be seen that the first and second contacts 54, 56 extend substantially completely between the end walls 52 of the sensing edge 20. This insures that the sensing edge is sensitive to external pressure along the entire length thereof. Another advantage of the present invention is that since the first end **32*a* of the first wall 32 is releasably secured to the lower channel 26 of the base member 22, the first wall 32 can be moved away from the base member 22 to access the cavity 36. In this position, the first and second contacts 54, 56 can be readily secured to the intermediate portions 34, 46 of the first and second walls 32, 44 with an adhesive. Similarly, the electrical conductors 58 can then be fished through the various apertures and channels and then connected with the control circuitry for the device. Once the first and second contacts 54, 56 are secured in place, the first end 32*a* of the first wall 32 is secured to the lower channel 26 of the base 22. The sensing edge 20 is then ready for attachment to the leading edge 18 of the horizontal shelf 14**.

Figure 4:
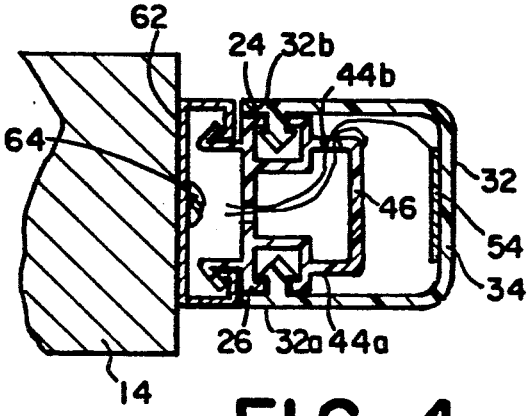
FIG. 4 is a reduced cross-sectional view of a sensing edge in accordance with an alternate embodiment of the invention.

Referring now to FIG. 4, there is shown a sensing edge 20 in accordance with an alternate embodiment of the present invention which is generally identical to the embodiment described above in connection with FIGS. 2 and 3 except for the following differences. In the alternate embodiment, the second end **32*b* of the first wall 32 is releasably secured to the upper channel 24 in a manner which is generally identical to the releasable connection shown in FIG. 2. By releasably connecting the first and second ends 32*a*, 32*b* of the first wall 32 to the lower and upper channels 26, 24 it is easier to manufacture the sensing edge 20 since the extrusion mold would be less sophisticated and the first and second contacts 54, 56 could be readily secured to the first and second walls 32, 44. In addition, the first end 44*a* of the second wall 44 is secured to the lower channel 26** during the molding process.

In operation, the sensing edge 20 contacts an object (i.e., a human being) in the path of the closing wall 11, the first wall 32 deflects toward the second wall 44 such that the first and second contacts 54, 56 contact each other and actuate the device. Since there is a slight delay before the device is actuated (due to the inherent delay characteristics of all control circuitry), the first wall 32 continues to deflect towards the horizontal shelf 14 causing the flexible second wall 44 to also deflect until the device is actuated. Thus, the intermediate position 46 of the second wall 44 is spaced from the base member 22 a sufficient distance to accommodate the continued deflection without the second wall 44 touching the base member 22. This continued deflection is commonly referred to as overtravel. Consequently, objects sensed by the present invention are not damaged due to overtravel.

From the foregoing description, it can be seen that the present invention comprises a sensing edge for causing an object moving in a first direction to move in a second direction by actuation of a device upon force being applied to the sensing edge. It will be appreciated by those skilled in the art, that changes could be made to the embodiments described above without departing from the broad inventive concepts thereof. It is understood, therefore, that this invention is not limited to the particular embodiments disclosed, but is intended to cover all modifications which are within the scope and spirit of the invention as defined by the appended claims.

What is claimed is:

1. A sensing edge for controlling movement of an object moving in a first direction by actuation of a device upon forcing being applied to the sensing edge, the sensing edge comprising:

an elongate base member for being secured to the object, said base member being constructed of a generally rigid material;

a first elongate wall having a first end and a second end, said first wall including an intermediate portion disposed between said first and second ends, said first and second ends being secured to said base member to form with the base member a cavity such that said intermediate portion is spaced from said base member, said first wall being constructed of a flexible material such that said first wall is compressible into said cavity upon application of external pressure thereto;

a second elongate wall having a first end and a second end, said first and second ends of said second wall being secured to said base member such that said second wall is positioned within said cavity between said first wall and said base member, said second wall being spaced from said first wall, said second wall including an intermediate portion disposed between the first and second ends thereof, said intermediate portion of said second wall being spaced from said base member and being generally aligned with the intermediate portion of the first wall; and switch means positioned within said cavity between said first wall and said base member for actuation of the device upon application of external pressure to the first wall.

2. The sensing edge as recited in claim 1 wherein said second wall is constructed of a flexible material to minimize damage due to overtravel.

3. The sensing edge as recited in claim 1 wherein said switch means comprises:

a first flexible, electrically conductive contact having a first face and a second face, said first contact being positioned between said first and second walls with said first face of said first contact being in facing engagement with said intermediate portion of said first wall; and a second electrically conductive contact having a first face and a second face, the second contact being formed of electrically conductive material and being positioned between said first and second walls with said second face of said second contact being in facing engagement with said intermediate portion of said second wall, whereby upon the application of external pressure to the first wall, a portion of the first contact deflects toward and engages said second contact and makes electrical contact therewith to thereby actuate the device.

4. The sensing edge as recited in claim 1 wherein said first end of said first wall is releasably secured to said base member for allowing said first wall to move towards and away from said base member about said second end thereof to provide access to said cavity.

5. The sensing edge as recited in claim 1 wherein said second end of said first wall is releasably secured to said base member for allowing said first wall to be readily removed from said base member.

6. The sensing edge as recited in claim 1 further including;

a mounting plate having a first surface and a second surface, the first surface for being attached to the object; and quick connect means interconnected between the base member and the mounting plate for quickly connecting and disconnecting the base member and mounting plate.

7. The sensing edge as recited in claim 6 wherein said quick connect means comprises a least one female member extending outwardly from the second surface of the mounting plate and at least one complementary male member extending outwardly from the base member for being releasably positioned within the female member.

8. A sensing edge for controlling movement of an object moving in a first direction by actuation of a device upon force being applied to the sensing edge, the sensing edge comprising:

an elongate base member for being secured to the object, said base member being constructed of a generally rigid material;

a first elongate wall having a first end and a second end, said first wall including an intermediate portion disposed between said first and second ends, said first and second ends being secured to said base member to form with the base member a cavity such that said intermediate portion is spaced from said base member, said first wall being constructed of a flexible material such that said first wall is compressible into said cavity upon application of external pressure thereto;

a second elongate wall having a first end and a second end, said first and second ends of said second wall being secured to said base member such that said second wall is positioned within said cavity between said first wall and said base member and said second wall is spaced from said first wall, said second wall being constructed of an electrically conductive material, said second wall includes an intermediate portion disposed between the first and second ends thereof, said intermediate portion of said second wall being spaced from said base member and being generally aligned with the intermediate portion of the first wall; and a flexible, electrically conductive contact having a first face and a second face, said first contact being positioned between said first and second walls with said first face of said first contact being in facing engagement with said first wall, whereby upon the application of external pressure to the first wall, a portion of the first contact deflects toward said second wall and makes electrical contact therewith to thereby actuate the device.

* * * * *